US009039430B2

(12) United States Patent
Ota et al.

(10) Patent No.: US 9,039,430 B2
(45) Date of Patent: May 26, 2015

(54) ELECTRIC CONNECTOR, TRAIN-INFORMATION TRANSMISSION/RECEPTION SYSTEM, AND METHOD FOR CONNECTING ELECTRIC CONNECTOR

(75) Inventors: Chihiro Ota, Tokyo (JP); Yoshihito Takigawa, Tokyo (JP); Yosuke Takaoka, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 31 days.

(21) Appl. No.: 13/877,685

(22) PCT Filed: Nov. 26, 2010

(86) PCT No.: PCT/JP2010/071147

§ 371 (c)(1),
(2), (4) Date: Apr. 4, 2013

(87) PCT Pub. No.: WO2012/070150

PCT Pub. Date: May 31, 2012

(65) Prior Publication Data

US 2013/0203289 A1 Aug. 8, 2013

(51) Int. Cl.
*H01R 4/66* (2006.01)
*H01R 13/6591* (2011.01)
(Continued)

(52) U.S. Cl.
CPC ..... *H01R 13/6591* (2013.01); *B61G 5/10* (2013.01); *B61L 15/0036* (2013.01);
(Continued)

(58) Field of Classification Search
CPC ..... H01R 4/64
USPC ..... 439/34, 502, 92, 95, 97; 174/51
See application file for complete search history.

(56) References Cited

U.S. PATENT DOCUMENTS 4,405,187 A 9/1983 Muellerr et al.
5,064,388 A 11/1991 Paladel
(Continued)

FOREIGN PATENT DOCUMENTS

DE 19717627 A1 10/1998
EP 0073112 A1 3/1983
(Continued)

OTHER PUBLICATIONS

International Search Report (PCT/ISA/210) issued on Feb. 22, 2011, by the Japanese Patent Office as the International Searching Authority for International Application No. PCT/JP2010/071147.
(Continued)

*Primary Examiner* — Phuong Dinh
(74) *Attorney, Agent, or Firm* — Buchanan Ingersoll & Rooney PC

(57) ABSTRACT

There is provided an electric connector that is interposed between an in-vehicle wire cable and a train information transmission/reception apparatus. The in-vehicle wire cable includes a plurality of signal lines that transmit train information and an electrically-conductive shielded layer surrounding the signal lines. One end of a ground line is connected to the shielded layer. A casing ground is provided on a casing of the train information transmission/reception apparatus and a plurality of plug pins electrically connected to the signal lines are provided on the casing of the train information transmission/reception apparatus. The other end of the ground line is connected to an electrically-conductive connector case, which is a casing of the electric connector, and the connector case is grounded via the casing of the train information transmission/reception apparatus when the signal lines and the plug pins are electrically connected to each other.

9 Claims, 9 Drawing Sheets

(51) Int. Cl.

| | |
|---|---|
| ***B61G 5/10*** | (2006.01) |
| ***B61L 15/00*** | (2006.01) |
| ***H01R 43/26*** | (2006.01) |
| ***H01R 9/03*** | (2006.01) |
| ***H01R 13/6596*** | (2011.01) |
| ***H01R 43/20*** | (2006.01) |

(52) U.S. Cl.

CPC ..... *H01R 43/26* (2013.01); *H01R 9/034* (2013.01); *H01R 2201/26* (2013.01); *H01R 13/6596* (2013.01); *H01R 43/20* (2013.01)

(56) References Cited

U.S. PATENT DOCUMENTS

| | | | | |
|---|---|---|---|---|
| 5,788,528 | A | 8/1998 | Orr, Jr. et al. | |
| 7,753,720 | B2 * | 7/2010 | Emoto et al. | 439/502 |
| 8,684,767 | B2 * | 4/2014 | Emoto et al. | 439/502 |
| 2009/0042436 | A1 | 2/2009 | Emoto et al. | |

FOREIGN PATENT DOCUMENTS

| | | | |
|---|---|---|---|
| EP | 1100161 | A2 | 5/2001 |
| EP | 1902893 | A1 | 3/2008 |
| JP | 57-182885 | | 11/1982 |
| JP | 62-128461 | A | 6/1987 |
| JP | 6-337744 | A | 12/1994 |
| JP | 2000-012161 | A | 1/2000 |
| JP | 2005-251507 | A | 9/2005 |
| JP | 2009-146229 | A | 7/2009 |
| WO | WO 2007/007495 | A1 | 1/2007 |

OTHER PUBLICATIONS

Written Opinion (PCT/ISA/237) issued on Feb. 22, 2011, by the Japanese Patent Office as the International Searching Authority for International Application No. PCT/JP2010/071147.

Japanese Office Action (Notification of Reason(s) for Refusal) dated Oct. 8, 2013, issued by the Japanese Patent Office in corresponding Japanese Patent Application No. 2012-545584, and an English Translation of the Office Action. (7 pages).

Written Opinion of the International Searching Authority (Translation)(Form PCT/ISA/237) issued on Feb. 22, 2011, in the corresponding International Application No. PCT/JP2010/071147. (7 pages).

Extended Search Report from European Patent Office dated Jun. 4, 2014, issued in corresponding European Patent Application No. 10860010.7. (11 pages).

* cited by examiner

| No. | PIGTAIL LENGTH L2 (mm) | DETERMI-NATION | NUMBER OF WDT OPERATIONS | |
|---|---|---|---|---|
| | | | +2 kV | -2 kV |
| 1 | 220 | NG | 8 | 8 |
| 2 | 80 | OK | 0 | 0 |
| 3 | 180 | NG | 0 | 8 |
| 4 | 160 | NG | 0 | 4 |
| 5 | 140 | OK | 0 | 0 |
| 6 | 140 | OK | 0 | 0 |
| 7 | 150 | NG | 0 | 5 |
| 8 | 150 | NG | 0 | 3 |
| 9 | 140 | NG | 0 | 6 |
| 10 | 120 | OK | 0 | 0 |

CASE OF L1a

POSITION OF SHIELD CLAMP IS CHANGED TO L1b

POSITION OF SHIELD CLAMP IS CHANGED TO L1b

ELECTRIC CONNECTOR, TRAIN-INFORMATION TRANSMISSION/RECEPTION SYSTEM, AND METHOD FOR CONNECTING ELECTRIC CONNECTOR

FIELD

The present invention relates to an electric connector mounted to a shielded cable for transferring information that is transmitted and received between train-information transmission/reception apparatuses, a train-information transmission/reception system using the electric connector, and a method for connecting the electric connector.

BACKGROUND

In an electric apparatus to be connected to a plurality of external apparatuses, various types of signal lines are generally wired in a high density due to a restriction in the size of a main unit of the apparatus. Particularly, in a train-information transmission/reception apparatus, which is one of the electric apparatuses incorporated in a railway vehicle, a plurality of signal lines are combined in a single connector so as to transmit various signals ranging from an analogue signal to a high-speed digital signal to and from a plurality of apparatuses having different functions. Therefore, a plurality of types of signals may exist in a mixed manner in a single connector.

A shielded cable, which is one of the media for transmitting a signal, is mainly configured with a conductor for transmitting signals and a shield (a shielded layer) covering the conductor. For example, in a conventional technique disclosed in Patent Literature 1, the following methods have been adopted to ground the shielded layer to a frame ground of the train-information transmission/reception apparatus.

A first method includes processing a shielded layer in a pigtail shape at a position farthest from a train-information transmission/reception apparatus (for example, a connector to be arranged in a connection portion between vehicles) and grounding the pigtail to a vehicle body. A second method includes processing a shielded layer in a pigtail shape near a train-information transmission/reception apparatus and providing a connector pin at an end portion of the pigtail. In this method, when the connector is connected to the train-information transmission/reception apparatus, the ground is secured via the connector pin, a GND line mounted to a substrate of the train-information transmission/reception apparatus, and a frame ground of the train-information transmission/reception apparatus.

CITATION LIST

Patent Literature

Patent Literature 1: International Publication No. WO2007/007495 (paragraphs 0035 to 0042, FIGS. 7 to 10)

SUMMARY

Technical Problem

However, in the first method, because the ground is secured at a position far from the train-information transmission/reception apparatus, noise applied to the shielded layer near the train-information transmission/reception apparatus cannot be fully released to the ground. This results in a problem that the noise may affect the train-information transmission/reception apparatus. Meanwhile, in the second method, because the shielded layer is grounded to the frame ground via the substrate, there is a problem that the noise from the shielded layer may be radiated to a semiconductor element and the like on the substrate and affects the train-information transmission/reception apparatus.

The present invention has been achieved in view of the above problems, and an object of the present invention is to provide an electric connector, a train-information transmission/reception system, and a method for connecting the electric connector that can reduce an influence of noise applied to an in-vehicle wire cable on a train-information transmission/reception apparatus.

Solution to Problem

There is provided an electric connector according to an aspect of the present invention that is, for allowing information transmission/reception apparatuses incorporated in a plurality of vehicles constituting a train to transmit and receive train information in an interconnecting manner via an in-vehicle cable, interposed between the in-vehicle cable and the information transmission/reception apparatus, wherein the in-vehicle cable internally includes a plurality of signal lines that transmit the train information and an electrically-conductive shielded layer surrounding the signal lines, one end of a ground line is connected to the shielded layer, the signal lines are connected to connector pins that are installed in an electrically-conductive connector case, which is a casing of an electric connector, and are electrically insulated from the connector case, a casing ground is provided to a casing of the information transmission/reception apparatus, and a plurality of contact pins electrically insulated from the casing and electrically connected to the connector pins are provided to the casing of the information transmission/reception apparatus, and the other end of the ground line is connected to the connector case in a detachable manner, and the connector case is electrically connected to the casing of the information transmission/reception apparatus in a state where the contact pins and the connector pins are respectively connected to each other.

Advantageous Effects of Invention

According to the present invention, a ground line connected to a shielded layer of an in-vehicle wire cable is configured to be connected to a connector case and grounded to a frame ground via a casing of a train-information transmission/reception apparatus when signal lines of the in-vehicle wire cable and contacts installed in the train-information transmission/reception apparatus are connected to each other, and therefore it is possible to reduce an influence of noise applied to the in-vehicle wire cable on the train-information transmission/reception apparatus.

DESCRIPTION OF EMBODIMENTS

Exemplary embodiments of an electric connector, a train-information transmission/reception system, and a method for connecting the electric connector according to the present invention will be explained below in detail with reference to the accompanying drawings. The present invention is not limited to the embodiments.

Embodiment

Figure 1:
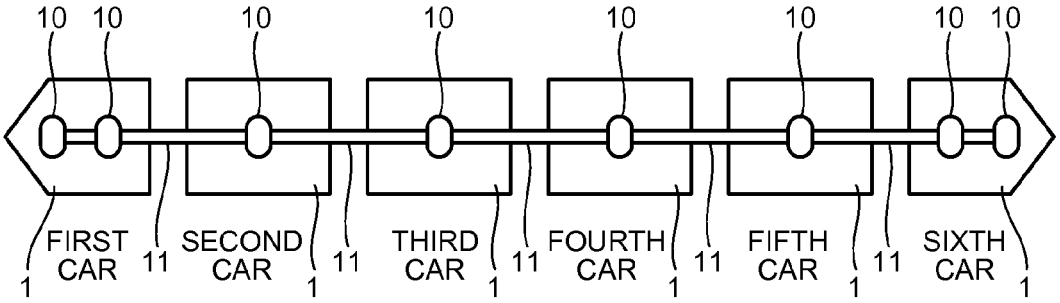
FIG. 1 depicts an outline of a train-information transmission/reception system according to an embodiment of the present invention.

FIG. 1 depicts an outline of a train-information transmission/reception system according to an embodiment of the present invention, conceptually depicting a relationship between the train-information transmission/reception system and a train. The train-information transmission/reception system includes, as main elements, a train-information transmission/reception apparatus 10 (hereinafter, simply "transmission/reception apparatus 10") incorporated in each of a plurality of vehicles 1 that configure the train and a transmission path 11 that connects the transmission/reception apparatuses 10 with each other.

The transmission/reception apparatus 10 controls various types of information (train information) for monitoring apparatuses incorporated in a train in an interconnecting manner, and transmits and receives the train information across the vehicles 1. Although two transmission/reception apparatuses 10 are incorporated in each of first vehicles on both sides and one transmission/reception apparatus 10 is incorporated in each of vehicles 1 other than the first vehicles in FIG. 1, for example, it is also possible to employ a configuration in which one transmission/reception apparatus 10 is arranged for a plurality of vehicles 1.

Figure 2:
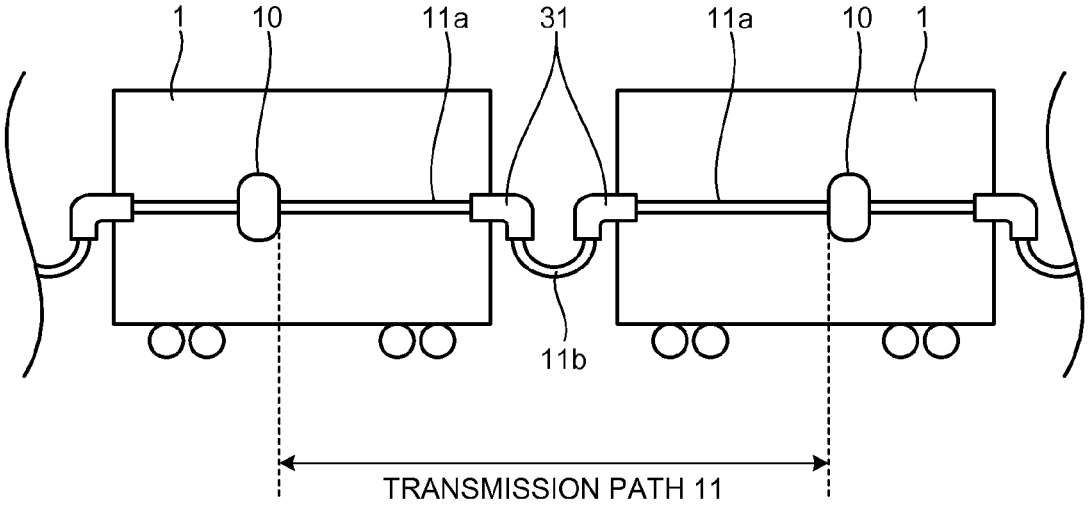
FIG. 2 depicts a connecting portion between vehicles of the train-information transmission/reception system shown in FIG. 1.

FIG. 2 depicts a connecting portion between the vehicles of the train-information transmission/reception system shown in FIG. 1. In FIG. 2, two adjacent vehicles 1 connected to each other are shown, and the transmission/reception apparatus 10 is incorporated in each of the vehicles 1. The transmission path 11 is arranged between the transmission/reception apparatuses 10.

More specifically, the transmission path 11 includes an in-vehicle wire cable 11*a* (hereinafter, simply "wire cable 11*a*"), a jumper cable 11*b* that is connected across the vehicles 1, and connectors 31 provided on the opposing sides of the vehicle 1 and each interposed between the wire cable 11*a* and the jumper cable 11*b*.

One end of the wire cable 11*a* is connected to the transmission/reception apparatus 10, and the other end is connected to the connector 31. The wire cable 11*a* and the jumper cable 11*b* are connected to each other via the connector 31. Therefore, the transmission/reception apparatus 10 incorporated in one vehicle 1 shown on the left side of FIG. 2 and the transmission/reception apparatus 10 incorporated in the other vehicle 1 shown on the right side of FIG. 2 are connected to each other as follows. That is, the transmission/reception apparatuses 10 are connected to each other via the wire cable 11*a* arranged in the one vehicle 1, the connector 31 installed in the one vehicle 1, the jumper cable 11*b*, the connector 31 installed in the other vehicle 1, and the wire cable 11*a* arranged in the other vehicle 1.

Figure 3:
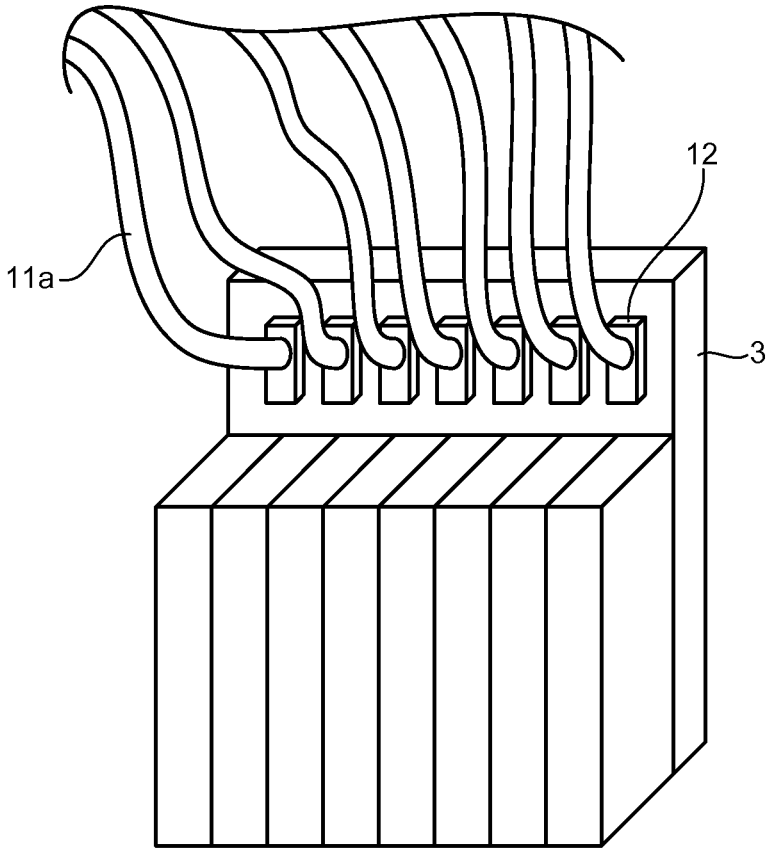
FIG. 3 is an external view of a train-information transmission/reception apparatus shown in FIG. 2.

FIG. 3 is an external view of the train-information transmission/reception apparatus 10 shown in FIG. 2. A casing 3 shown in FIG. 3 is a casing of the transmission/reception apparatus 10. A plurality of wire cables 11*a* are connected to an upper side surface of the casing 3. One end of each of the wire cables 11*a* is processed for connection, so that the one end of each of the wire cables 11*a* is connected to the casing 3 in a detachable manner. Details of an electric connector 12 are explained later.

A CPU board or the like for performing various processes by using the train information and the like is mounted on a lower side surface of the electric connector 12, and for example, the CPU board and the electric connector 12 are connected to a printed circuit board 46, which is explained later. Although one wire cable 11*a* is connected to the electric connector 12 shown in FIG. 3, two or more wire cables 11*a* may be connected to one electric connector 12. A relationship of electrical connection among the electric connector 12, the wire cable 11*a*, and the casing 3 of the transmission/reception apparatus 10 is explained in the following descriptions.

Figure 4:
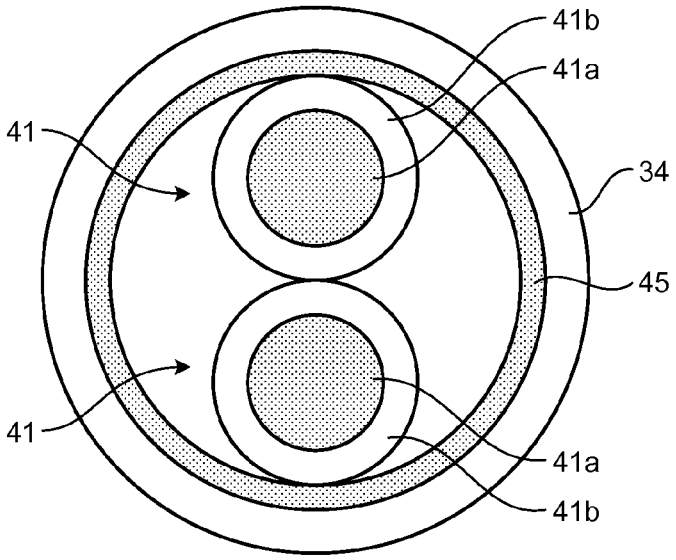
FIG. 4 is a cross-sectional view of a twisted-pair cable used as an in-vehicle wire cable.

FIG. 4 is a cross-sectional view of a twisted-pair cable used as the in-vehicle wire cable 11*a*. The twisted-pair cable includes two insulated electric wires (signal lines 41) twisted together and each including a conductor 41*a* and an insulation layer 41*b* surrounding and covering the conductor 41*a*, a shielded layer 45 surrounding the twisted-pair cable, and a sheath (a protective cover) 34 surrounding and covering the shielded layer 45. A configuration of grounding the shielded layer 45 is explained below.

Figure 5:
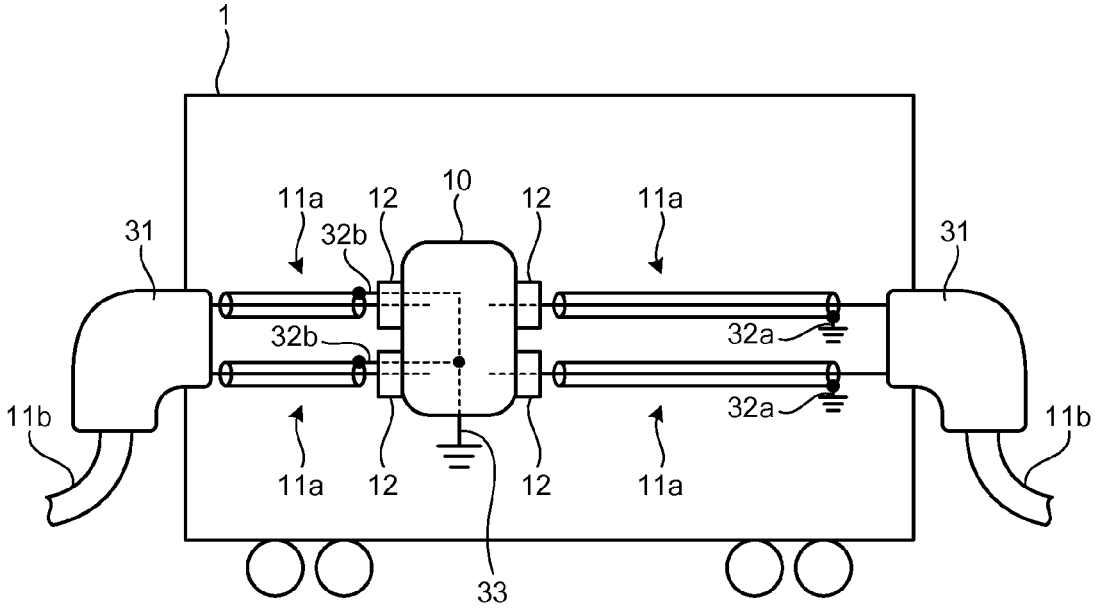
FIG. 5 is an explanatory diagram of a general mode of grounding a shielded layer in a conventional technique.

FIG. 5 is an explanatory diagram of a general mode of grounding a shielded layer in a conventional technique. In the vehicle 1 shown in FIG. 5, a plurality of wire cables 11*a* are arranged and a plurality of electric connectors 12 respectively mounted to the wire cables 11*a* are connected to the transmission/reception apparatus 10.

The wire cable 11*a*, which is grounded by the first method described above, is shown on the right side of the transmission/reception apparatus 10. That is, one end of a shielded ground line 32*a* is connected to the shielded layer 45 shown in FIG. 4 at a position farthest from the transmission/reception apparatus 10, and the other end of the shielded ground line 32*a* is connected to a body of the vehicle. A connection destination of the other end of the shielded ground line 32*a* can be, for example, the connector 31, because the connector 31 also functions as a ground terminal for the vehicle 1.

In this manner, in the first method, only one end of the wire cable 11*a* is grounded (one-end grounding). In the case of one-end grounding, anti-noise performance is degraded as compared to a case of both-end grounding because a potential difference is generated on the wire cable 11*a*. However, in a railway vehicle, because a high voltage is used, a ground-fault current may flow from one end to the other end when the both ends are grounded. Therefore, in the railway vehicle, it is a common practice to ground one end of the wire cable 11*a*, due to the reasons specific to railway vehicles.

The wire cable 11*a*, which is grounded by the second method, is shown on the left side of the transmission/reception apparatus 10. That is, one end of a shielded ground line 32*b* is connected to the shielded layer 45 shown in FIG. 4, and the other end of the shielded ground line 32*b* is grounded to a frame ground (a casing ground 33) of the transmission/reception apparatus 10 via a connector pin provided to the other end of the shielded ground line 32*b* and a substrate of the transmission/reception apparatus 10. The substrate is explained later. A dotted line in the transmission/reception apparatus 10 represents a GND line mounted to the substrate, and the shielded ground line 32*b* is grounded via the GND line.

Figure 6:
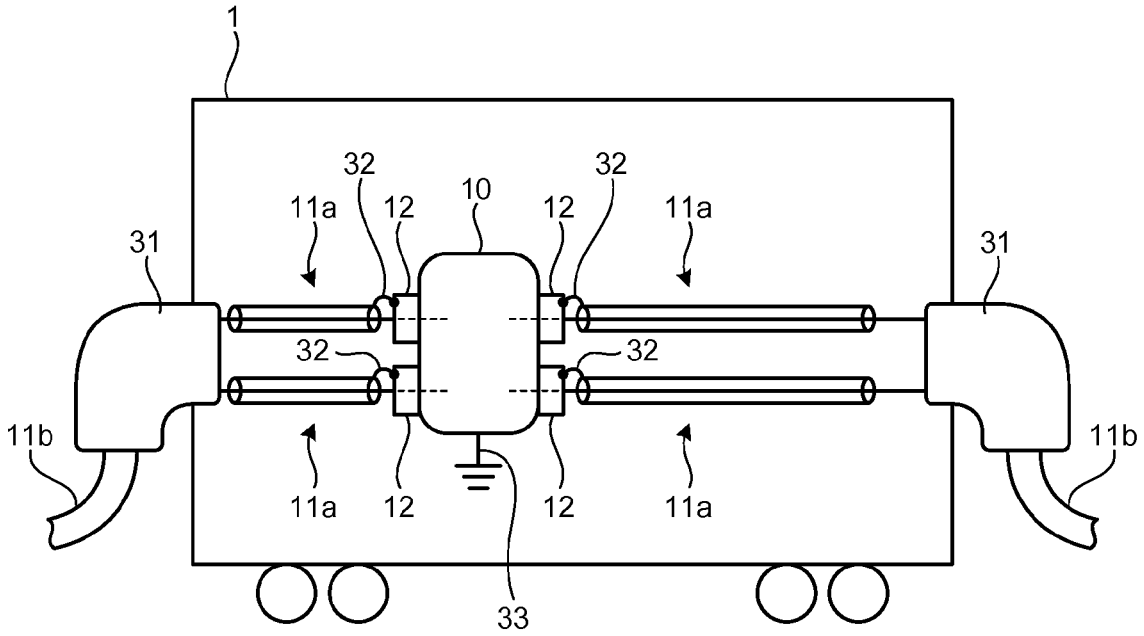
FIG. 6 is an explanatory diagram of a mode of grounding a shielded layer according to the embodiment of the present invention.

FIG. 6 is an explanatory diagram of a configuration of grounding the shielded layer according to the embodiment of the present invention. Similarly to FIG. 5, a plurality of wire cables 11*a* are arranged in the vehicle 1, and a plurality of electric connectors 12 respectively mounted to the wire cables 11*a* are connected to the transmission/reception apparatus 10. FIG. 6 is different from FIG. 5 in that the other end of a shielded ground line 32 (hereinafter, simply "ground line 32") connected to the shielded layer 45 (see FIG. 4) is connected to an electrically-conductive connector case 12*a* (hereinafter, simply "case 12*a*") that is a casing of the electric connector 12.

With this configuration, noise applied to the shielded layer 45 from various apparatuses arranged near the wire cables 11*a* flows to the casing ground 33 via the casing of the electric connector 12 and the casing of the transmission/reception apparatus 10. That is, this noise flows to the casing ground 33 without passing through the substrate of the transmission/reception apparatus 10. A configuration of the electric connector 12 is explained below in detail.

Figure 7:
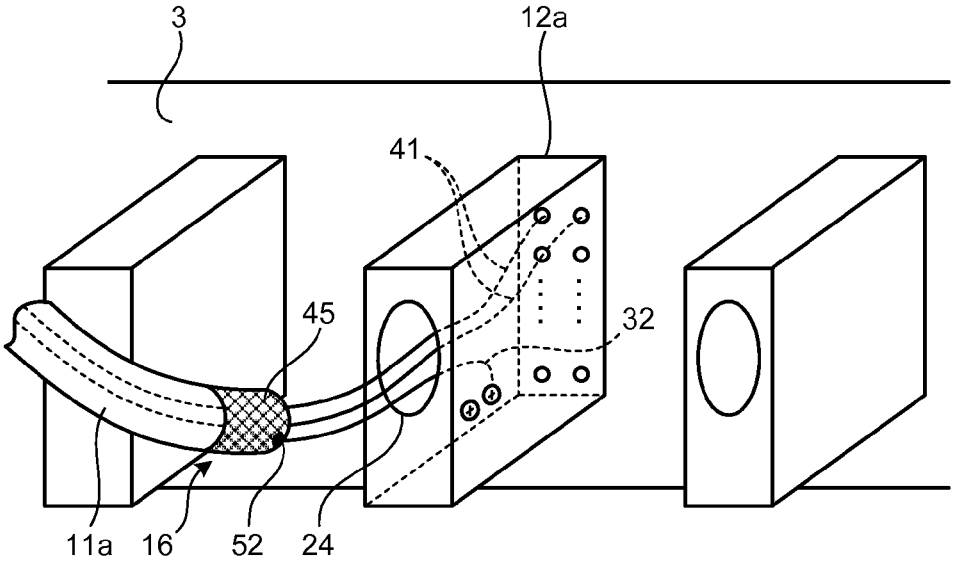
FIG. 7 is an explanatory diagram of a relationship between a casing of an electric connector and in-vehicle wire cables.
Figure 8:
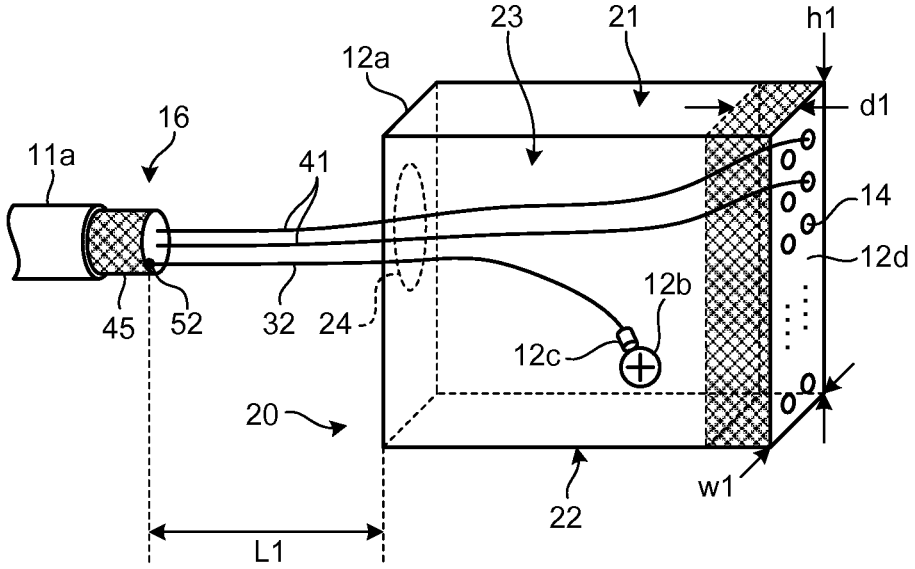
FIG. 8 is an explanatory diagram of a relationship between a configuration of the electric connector and a processed portion of an in-vehicle wire cable.
Figure 9:
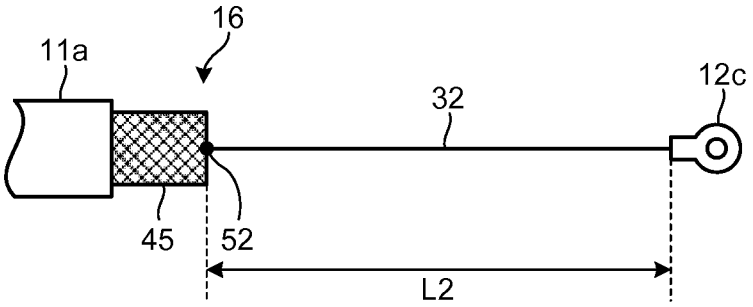
FIG. 9 is an explanatory diagram of a length from the processed portion of the in-vehicle wire cable to a terminal of a ground line.

FIG. 7 is an explanatory diagram of a relationship between the casing of the electric connector 12 and the wire cables 11*a*, and FIG. 8 is an explanatory diagram of a relationship between the configuration of the electric connector 12 and a processed portion 16 of the in-vehicle wire cable 11*a*. FIG. 9 is an explanatory diagram of a length from the processed portion 16 of the in-vehicle wire cable 11*a* to a terminal 12*c* of the ground line 32.

In FIGS. 7 and 8, the case 12*a* of the electric connector 12 is formed in a cuboid with a width in the lateral direction narrower than a width in the longitudinal direction. For simplicity, the case 12*a* shown in FIGS. 7 and 8 is formed in a hexahedron including a cable introducing surface 20, an upper surface 21, a lower surface 22, and side surfaces 23; however, the configuration is not limited to this.

An opening 24 for allowing the signal lines 41 and the ground line 32 to be introduced into the case 12*a* is provided on the cable introducing surface 20. The electrically-conductive terminal 12*c* mounted to the end portion of the ground line 32 is connected to the side surface 23 of the case 12*a* with a terminal mounting screw (a fixing member) 12*b* in a detachable manner. The terminal 12*c* is fixed by the terminal mounting screw 12*b* for an easy maintenance. In the present embodiment, for example, the terminal 12*c* is connected to the case 12*a* by using the terminal mounting screw 12*b*; however, the mounting member is not limited to a screw. A fastening member other than a screw or a fixing member can be also used.

Furthermore, a connector connection unit 12*d* including pin holes 14 formed to include a plurality of connector pins (for example, jack pins) is attached on the case 12*a*. The connector pins are installed in the electrically-conductive connector case 12*a* in a state where the connector pins are electrically isolated from the connector case 12*a*. The connector connection unit 12*d* is mounted inside the case 12*a* in such a manner that the connector connection unit 12*d* is surrounded by the case 12*a* except for the side of the pin holes 14.

The sheath 34 of the wire cable 11*a* shown in FIG. 4 is peeled near the opening 24 of the case 12*a*, and the shielded layer 45 is processed in a pigtail shape. The ground line 32 is connected to the shielded layer 45 that is processed in the pigtail shape by using a shield clamp 52. In FIGS. 7 to 9, only a state where the shielded layer 45 and the ground line 32 are electrically connected to each other is shown; however, a portion processed in the pigtail shape is omitted from these drawings. A tip of each of the signal lines 41 from the wire cable 11*a* is processed in a pin shape and buried into a predetermined position of the connector connection unit 12*d*.

The processed portion 16 of the wire cable 11*a* indicates a portion for processing the shielded layer 45. The shielded layer 45 and the ground line 32 are electrically connected to each other on the portion. FIG. 8 depicts a distance L1 from the processed portion 16 to the cable introducing surface 20, and FIG. 9 depicts a length L2 of the ground line 32 from the processed portion 16 to the terminal 12*c*. The distance L1 and the length L2 are explained later.

Figure 10:
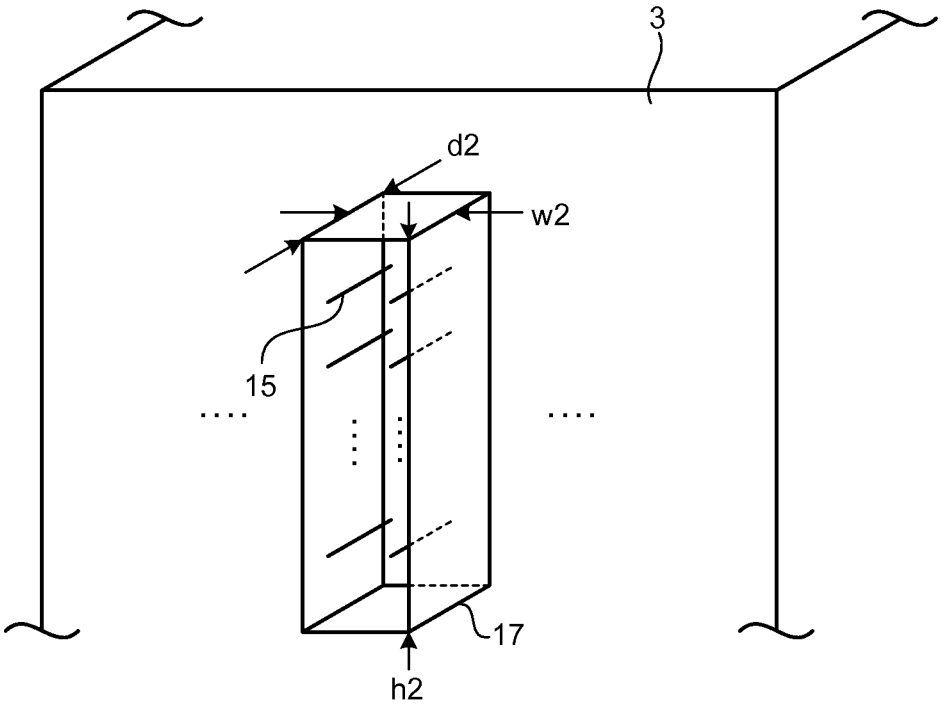
FIG. 10 depicts a connector housing formed in a casing of the train-information transmission/reception apparatus.

FIG. 10 depicts a connector housing 17 formed in the casing 3 of the train-information transmission/reception apparatus 10. The electrically-conductive connector housing 17 (hereinafter, simply "housing 17") that is electrically connected to the casing 3 is formed while surrounding a plurality of contact pins 15 (for example, plug pins) on the casing 3. Each of the contact pins 15 is electrically connected to the printed circuit board 46, which is explained later, electrically isolated from the casing 3, and arranged to be inserted into each of the pin holes 14 shown in FIG. 8.

Dimensions of the housing 17 shown in FIG. 10 and the case 12*a* shown in FIG. 8 are explained below. In FIG. 10, a depth d2 corresponding to a length from the end portion of the housing 17 to the surface of the casing 3 is, for example, about several to ten-odd millimeters, which corresponds to a predetermined length d1 from the end portion of the case 12*a* shown in FIG. 8. A width w2 of the inner circumferential surface of the housing 17 shown in FIG. 10 is formed with a dimension substantially matching a width w1 of the outer circumferential surface of the case 12*a* shown in FIG. 8. A height h2 of the inner circumferential surface of the housing 17 shown in FIG. 10 is formed with a dimension substantially matching a height h1 of the outer circumferential surface of the case 12*a* shown in FIG. 8.

By forming the housing 17 in the shape mentioned above, when the outer circumferential surface of the case 12*a* is thought of as a convex portion and the inner circumferential surface of the housing 17 as a concave portion, the convex portion is fitted into the concave portion and the outer circumferential surface of the case 12*a* and the inner circumferential surface of the housing 17 are brought into surface contact with each other. That is, the case 12*a* is formed to be capable of being brought into contact with the inner circumferential surface of the housing 17 in a state where the contact pins 15 and the connector pins are engaged with each other. Although it is preferred to form the case 12*a* such that all surfaces of the outer circumferential surface thereof are brought into contact with the inner circumferential surface of the housing 17, it may be configured such that only a part of the surfaces (for example, the side surfaces 23) is brought into contact with the inner circumferential surface of the housing 17. Also in this case, as compared to the conventional second method in which the ground is secured via the pins inserted into the pin holes 14, the impedance is greatly reduced, and further with respect to vibration generated while the train is running, mechanical and electrical connection of the electric connector 12 is stabilized.

Furthermore, it is also possible to attach the case 12*a* to the contact pins 15 without using the housing 17. In this case, the impedance is increased as compared to the case of using the housing 17 because the end portion of the case 12*a* that surrounds the connector connection unit 12*d* and the casing 3 are brought into point contact with each other. However, the impedance is smaller than the impedance in the case of using the conventional second method.

Figure 11:
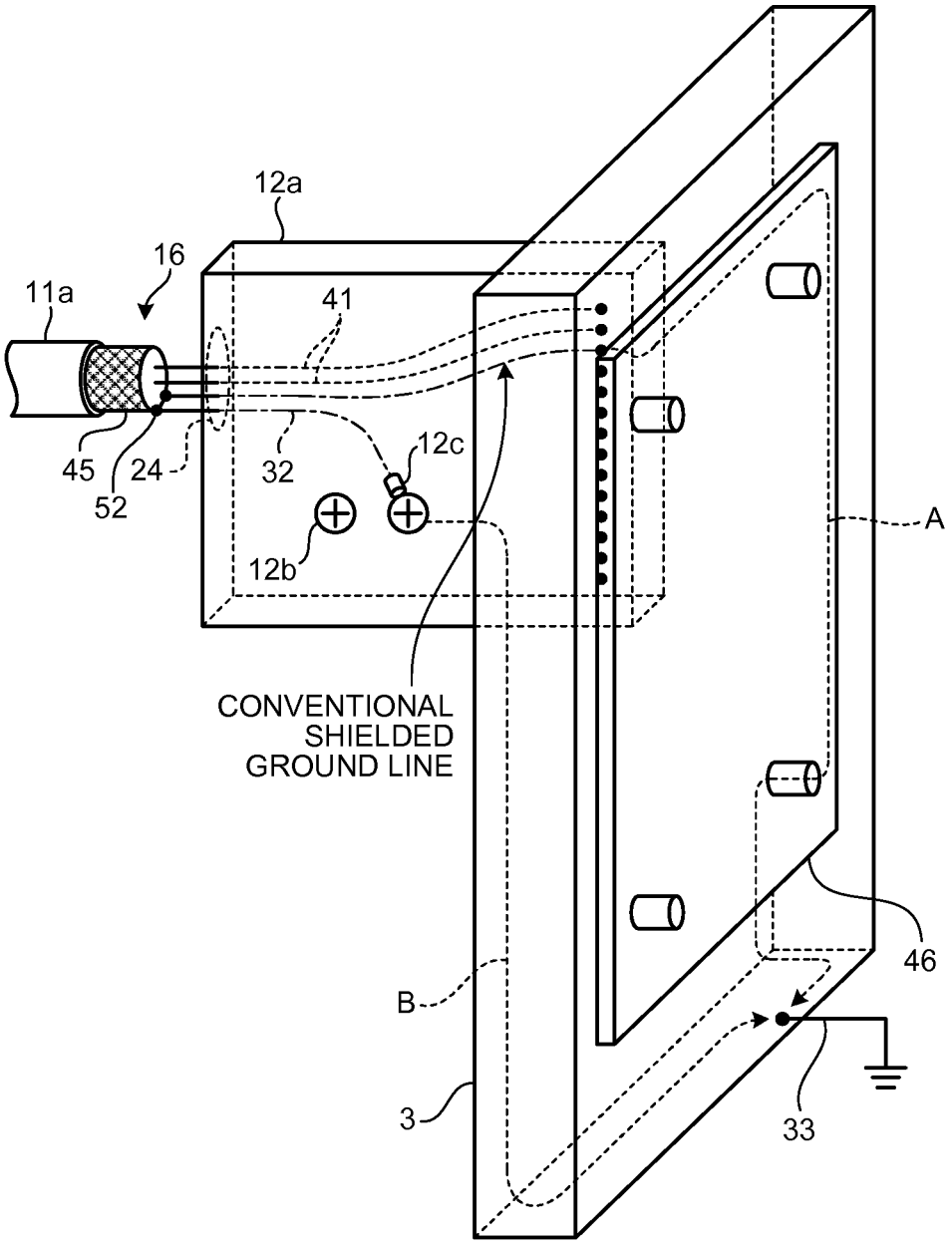
FIG. 11 depicts a state where an electric connector is mounted to a connector housing shown in FIG. 10.

FIG. 11 depicts a state where an electric connector is mounted to the connector housing 17 shown in FIG. 10. FIG. 11 depicts the casing 3 of the transmission/reception apparatus 10 and the printed circuit board 46 arranged in the casing 3. A GND line (not shown) mounted to the printed circuit board 46 is connected to the casing ground 33 of the casing 3. FIG. 11 further depicts a "conventional shielded ground line" used in the second method and the ground line 32 according to the present embodiment.

A dotted line indicated by a symbol A represents a path of the noise flowing to the casing ground 33 via the "conventional shielded ground line" shown in FIG. 11. That is, the noise applied to the wire cable 11*a* flows to the casing ground 33 via the "conventional shielded ground line" and the GND line mounted to the printed circuit board 46.

On the other hand, a dotted line indicated by a symbol B represents a path of the noise when the electric connector 12 according to the present embodiment is used. That is, the noise applied to the wire cable 11*a* flows to the casing ground 33 via the terminal 12*c*, the case 12*a*, and the casing 3 without passing through the printed circuit board 46.

The distance L1 and the length L2 shown in FIGS. 8 and 9 are explained next. First, the distance L1 is explained. As shown in FIG. 8, when the connection of the ground line 32 is performed outside the case 12*a*, the noise from various apparatuses installed around the wire cable 11*a* is applied to the signal lines 41 that do not have a shield, and therefore it is desired that the distance L1 is as short as possible.

However, there may be a case where about ten lines including the signal lines 41 and the ground line 32 are introduced into the opening 24 shown in FIG. 8. Although the influence of the noise from various apparatuses is decreased as the distance L1 is decreased, not only it becomes difficult to smoothly introduce a plurality of cables into the opening 24 but also it becomes difficult to assemble the case 12*a* as the distance L1 is decreased. Therefore, it is desired that the distance L1 is set to a length with which both the anti-noise performance and the assembling workability of the case 12*a* can be achieved.

Meanwhile, considering the workability when connecting the ground line 32 to the inside of the case 12*a* (for example, the side surface 23), the length L2 of the ground line 32 is set to a length with a margin. Although the flexibility of the position to connect the terminal 12*c* is increased so that the workability of the ground line 32 is improved as the length L2 is increased, the impedance of the ground line 32 is increased and the anti-noise performance is degraded as the length L2 is increased. Therefore, it is desired that the length L2 is set to a length with which both the workability of the ground line 32 and the anti-noise performance can be achieved.

The present inventors have found optimum values of the distance L1 and the length L2 through experiments. The optimum values are explained below with reference to FIG. 12.

Figures 12, 13:
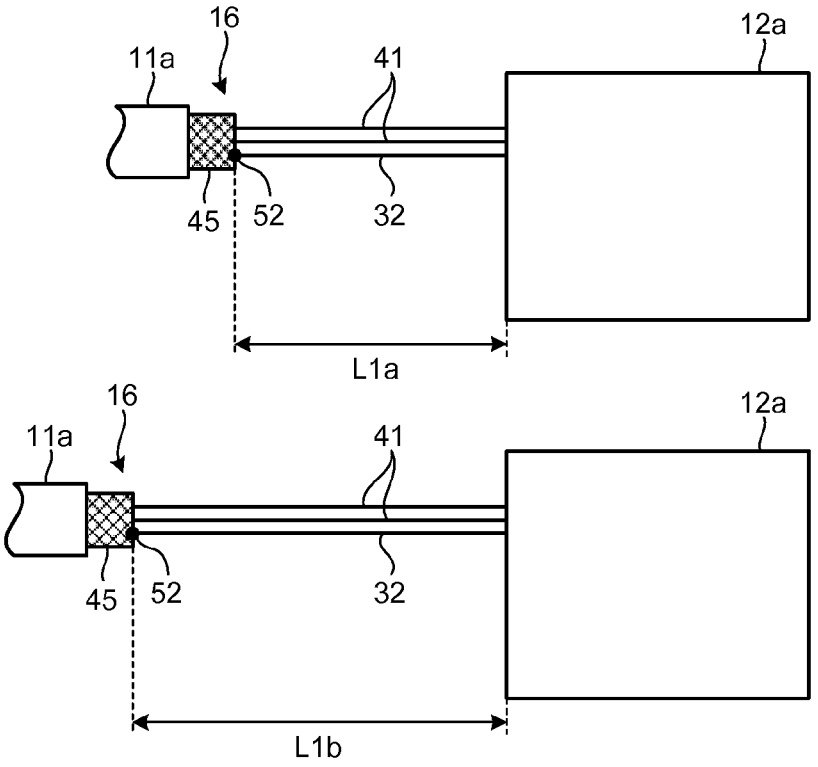
FIG. 12 depicts a relationship between a length of the ground line and the number of operations of a WDT.
FIG. 13 depicts a state where a distance from the processed portion to a cable introducing surface is changed.

FIG. 12 depicts a relationship between the length L2 of the ground line 32 and the number of operations of a WDT (watchdog timer). The table shown in FIG. 12 is a result of a burst immunity test conducted by using the electric connector 12 according to the present embodiment under a condition in which the train-information transmission/reception system is reproduced in a simulated manner. The burst immunity test conforms to the IEC 62236-3-2 (electromagnetic compatibility of apparatuses incorporated in railway vehicles), which determines whether an apparatus malfunctions when, for example, noise of ±2 kilovolts and 5 kilohertz is applied to a cable.

The data shown in FIG. 12 indicate the number of operations of the WDT when, for example, the ground line 32 is connected as shown in FIG. 11 and noise of +2 kilovolts and noise of −2 kilovolts are respectively applied with the length L2 of the ground line 32 changed in a range from 120 millimeters to 220 millimeters. When the WDT is counted even one time, the "determination" is "NG".

For example, when L2 is 220 millimeters in No. 1, the determination is NG with respect to both the noise of +2 kilovolts and of −2 kilovolts.

When L2 is 80 millimeters in No. 2, the number of operations of the WDT is zero with respect to both the noise of +2 kilovolts and the noise of −2 kilovolts. This can be considered that the impedance of the ground line 32 was sufficiently reduced so that the anti-noise performance was improved.

Subsequently, the operation was checked when L2 was changed to be longer than 80 millimeters to check a range in which the determination is "OK".

Nos. 3 and 4 show data obtained when L2 was changed to 160 millimeters and 180 millimeters, where both determinations are "NG".

In Nos. 5 and 6, experiments were conducted twice with L2 set to 140 millimeters for confirmation, where both determinations are "OK".

Subsequently, experiments were performed for Nos. 7 to 9 to check a range from 140 millimeters to 160 millimeters.

In No. 7, when L2 is 150 millimeters, the determination is "NG". The number of operations of the WDT at this time is 5 for the noise of −2 kilovolts. Meanwhile, No. 8 indicates data obtained when a shielded copper tape is applied to a section of the distance L1 while L2 is left unchanged to be 150 millimeters. However, the determination is "NG".

No. 9 indicates data obtained when L2 was set to 140 millimeters again. In this case, the distance from the case 12*a* to the processed portion 16 is increased by changing the position of the shield clamp 52 with the length L2 of the ground line 32 left unchanged (see FIG. 9). The shield clamp 52 indicates a portion where the shielded layer 45 and the ground line 32 are connected to each other in FIG. 8. This aspect is explained below in detail with reference to FIG. 13.

FIG. 13 depicts a state where the distance from the processed portion 16 to the cable introducing surface 20 is changed, where the upper side indicates the distance L1 (L1*a*) when the position of the shield clamp 52 is close to the case 12*a*, and the lower side indicates the distance L1 (L1*b*) when the position of the shield clamp 52 is located distant from the case 12*a*.

More specifically, Nos. 5 and 6 in FIG. 12 indicate data obtained when the length L2 of the ground line 32 is 140 millimeters and the distance L1 is L1*a* shown in FIG. 13.

Meanwhile, data of No. 9 in FIG. 12 are data obtained when the length L2 of the ground line 32 is 140 millimeters and the distance L1 is L1*b* shown in FIG. 13. The distance L1*b* is a distance when the position of the shield clamp 52 is moved away from the distance L1*a* by 50 millimeters. The distance L1*b* is, for example, 65 millimeters. The number of operations of the WDT in No. 9 is zero for the noise of +2 kilovolts but 6 for the noise of −2 kilovolts. That is, even when the length L2 of the ground line 32 is the same, when the distance L1 is changed from L1*a* to L1*b* (that is, when the position of the processed portion 16 is moved away), it is found that the anti-noise performance is degraded.

Data of No. 10 are data obtained when the length L2 of the ground line 32 is decreased from 140 millimeters to 120 millimeters with the distance L1*b* left unchanged. The number of operations of the WDT at this time is zero for both the noise of +2 kilovolts and the noise of −2 kilovolts. It is found that the impedance of the ground line 32 is decreased so that the anti-noise performance is improved simply by decreasing the length L2 of the ground line 32 by 20 millimeters.

In this manner, both the anti-noise performance and the assembling workability of the case 12*a* can be achieved with such a configuration that the distance L1 from the processed portion 16 to the cable introducing surface 20 is equal to or shorter than 65 millimeters and the length L2 of the ground line 32 from the processed portion 16 to the terminal 12*c* is equal to or shorter than 120 millimeters.

Figure 14:
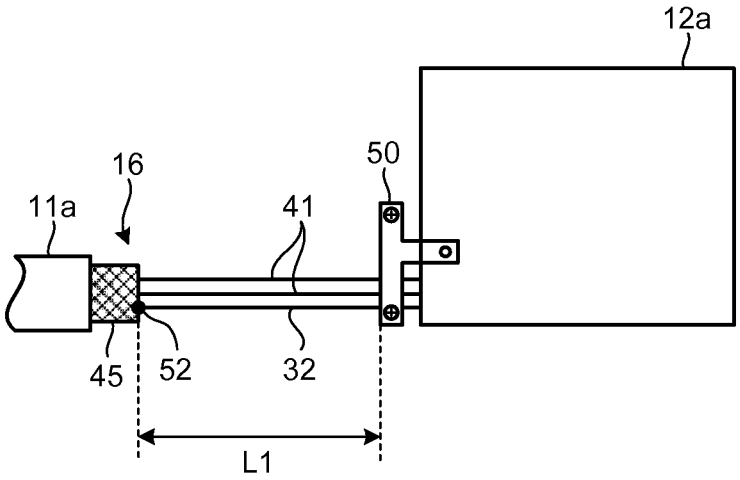
FIG. 14 depicts a connector case including a cable clamp.

A case where the case 12*a* including a cable clamp 50 is employed is explained next. FIG. 14 depicts the case 12*a* including the cable clamp 50. The cable clamp 50 is attached to the case 12*a* shown in FIG. 14. The cable clamp 50 is a member for bundling a plurality of cables (the signal lines 41 and the ground line 32), which is an electrically-conductive member attached to the case 12*a* near the opening 24 shown in FIG. 8 in a state of being electrically connected to the case 12*a*.

The case 12*a* and the cable clamp 50 shown in FIG. 14 can be regarded as a single conductor as a whole. In this case, a distance from the processed portion 16 to the cable clamp 50 can be regarded as the distance L1 shown in FIG. 8.

Generally, a section from the processed portion 16 to the cable clamp 50 is covered by a protective net (not shown) for protecting the whole cable. In this case, the end of the protective net is inserted between the cable clamp 50 and the cable and fixed by the cable clamp 50. Therefore, the cable including the ground line 32 processed at the processed portion 16 is introduced into the case 12*a* in a state of being accommodated in the protective net. In other words, when the end of the ground line 32 is connected to the cable clamp 50 or to outside of the case 12*a*, it is not possible to protect the ground line 32 and the like.

Because the electric connector 12 according to the present embodiment has a configuration in which the ground line 32 is connected inside the case 12*a*, the section from the processed portion 16 to the cable clamp 50 can be protected by the protective net, and the anti-noise performance of the signal lines 41 can be improved.

Figure 15:
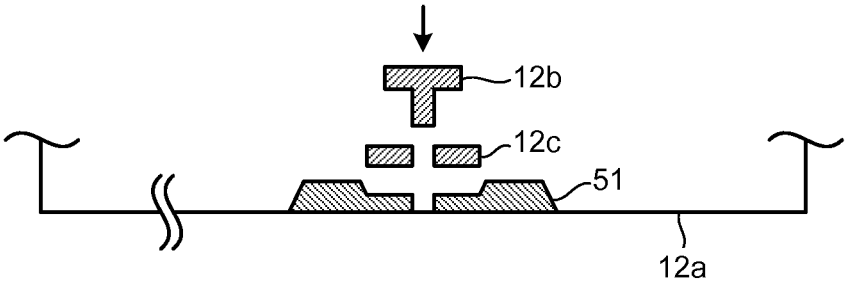
FIG. 15 depicts a cross section of a terminal block formed in a connector case.

FIG. 15 depicts a cross section of a terminal block 51 formed in a connector case, and depicts a state where the terminal 12*c* connected to the side surface 23 of the case 12*a* is viewed from the upper surface 21 of the case 12*a* (see FIG. 8). The terminal block 51 is a member for electrically connecting the terminal 12*c* and the case 12*a*, which is located between the case 12*a* and the terminal 12*c* for fixing the terminal 12*c* by using the terminal mounting screw 12*b*. The terminal mounting screw 12*b* is screwed into a hole formed on the terminal block 51.

By providing the terminal block 51 on the inner circumferential surface of the case 12*a*, the workability in screwing the terminal mounting screw 12*b* on the side surface 23 of the case 12*a* is improved, and it becomes easy to manage the torque of the terminal mounting screw 12*b*. Because the terminal 12*c* can be solidly fixed to the case 12*a*, the contact impedance between the ground line 32 and the case 12*a* can be reduced as a result.

It is desirable to set the position for connecting the terminal 12*c*, for example, near the opening 24 shown in FIG. 8 and on the side surface 23 of the case 12*a*. Although it is also possible to connect the terminal 12*c* to the upper surface 21 or the lower surface 22 of the case 12*a*, in this case, it becomes difficult to check the state of wiring inside the case 12*a* from an inspection port (not shown) formed on the lower surface 22 or the upper surface 21 of the case 12*a*. In addition, when the ground line 32 is connected at a position far from the opening 24, the length of the ground line 32 is inevitably increased so that the impedance is increased. From these points of view, it is desirable to connect the terminal 12*c* at a position near the opening 24 and on the side surface 23 of the case 12*a*.

An operation is explained below. One end of the ground line 32 is connected to the shielded layer 45 outside the case 12*a* shown in FIG. 8, and the ground line 32 and the signal lines 41 are introduced into the opening 24 of the case 12*a*. The other end of the ground line 32 that is introduced into the case 12*a* is connected to the side surface 23, which is the widest surface of the case 12*a*, by using the terminal 12*c* and the terminal mounting screw 12*b*. Ends of the signal lines 41 are processed to be arranged in the pin holes 14 formed on the connector connection unit 12*d*. At this time, the distance L1 from the processed portion 16 to the cable introducing surface 20 is set to, for example, equal to or shorter than 65 millimeters, and the length L2 of the ground line 32 from the processed portion 16 to the terminal 12*c* (see FIG. 9) is set to, for example, equal to or shorter than 120 millimeters.

Meanwhile, on the casing 3 of the transmission/reception apparatus 10, the casing ground 33 shown in FIG. 11 is provided and the contact pins 15 (contact pins) electrically connected to the signal lines 41 as shown in FIG. 10 are provided.

Subsequently, when the case 12*a* configured in the above manner is connected to the contact pins 15, the shielded layer 45 is connected to the casing ground 33 via the ground line 32, the terminal 12*c*, the case 12*a*, and the casing 3 as shown in FIG. 11.

Furthermore, as shown in FIG. 10, when the electrically-conductive housing 17 that surrounds the contact pins 15 and is formed to be engageable with the outer circumferential surface of the case 12*a* is formed in the casing 3, the case 12*a* is grounded via the housing 17 when the signal lines 41 and the contact pins 15 are connected to each other. That is, as shown in FIG. 11, the shielded layer 45 is connected to the casing ground 33 via the ground line 32, the terminal 12*c*, the case 12*a*, and the casing 3.

Further, when the terminal block 51 shown in FIG. 15 is provided, the shielded layer 45 is connected to the casing ground 33 via the ground line 32, the terminal 12*c*, the terminal block 51, the case 12*a*, and the casing 3.

Although the connector pins have been explained as jack pins and the contact pins 15 have been explained as plug pins as an example in the above descriptions, the connector pins can be plug pins and the contact pins 15 can be jack pins.

As described above, the electric connector and the train information transmission/reception apparatus according to the present embodiment are electrically connected to the casing 3 of the transmission/reception apparatus 10 in a state where the contact pins 15 and the connector pins are connected to each other, and include the case 12*a* on which the terminal block 51 that is interposed between the case 12*a* and the electrically-conductive terminal 12*c* provided on the other end of the ground line 32 and fixes the terminal 12*c* by using the terminal mounting screw 12*b* is provided. Therefore, the noise propagating through the shielded layer 45 in the wire cable 11*a* can be released to the frame ground (the casing ground 33) without passing through an electric circuit inside the transmission/reception apparatus 10. Particularly, the noise applied to the wire cable 11*a* near the transmission/reception apparatus 10 can be effectively released to the casing ground 33. In addition, because a frame ground pin is not needed in the connector connection unit 12*d* shown in FIG. 8, it is possible to introduce more signal lines into the electric connector 12.

Furthermore, the electric connector 12 according to the present embodiment is configured such that the casing ground is completed by electrically connecting the connector case 12*a* to which the ground line 32 is connected and the housing 17 right before the contact pins 15 and the connector pins are electrically connected to each other. That is, before the contact pins 15 are inserted into the connector pins, a countermeasure is taken against the noise by providing grounding of the shielded layer 45. Therefore, the electric connector 12 according to the present embodiment can effectively suppress the influence of noise applied to an in-vehicle wire cable on the train information transmission/reception apparatus.

In the present embodiment, although a configuration in which the inner circumferential surface of the housing 17 is brought into electrical contact to the outer circumferential surface of the case 12*a* has been explained, if it is configured that an outer circumferential surface of the housing 17 is brought into electrical contact with an inner circumferential surface of the case 12*a*, same effects can be achieved.

The electric connector and the train-information transmission/reception system described in the present embodiment are only examples according to the present invention, and these can be combined with other well-known techniques, and it is needless to mention that the electric connector and the train-information transmission/reception system can be configured while modifying them without departing from the gist of the invention, such as omitting a part of their configurations.

INDUSTRIAL APPLICABILITY

As described above, the present invention can be applicable to both an electric connector mounted to a train-information transmission/reception apparatus and a train-information transmission/reception system, and the present invention is particularly useful as an invention that can reduce an influence of noise applied to a shielded cable on an information transmission/reception apparatus.

REFERENCE SIGNS LIST

1 vehicle
3 casing
10 train-information transmission/reception apparatus
11 transmission path
11*a* in-vehicle wire cable (in-vehicle cable)
11*b* jumper cable
12 electric connector
12*a* connector case
12*b* terminal mounting screw (fixing member)
12*c* terminal
12*d* connector connection unit
14 pin hole
15 contact pin
16 processed portion
17 connector housing
20 cable introducing surface
21 upper surface
22 lower surface
23 side surface
24 opening
31 connector
32, 32*a*, 32*b* shielded ground line
33 casing ground
34 sheath
41 signal line
41*a* conductor
41*b* insulation layer
45 shielded layer
46 printed circuit board
50 cable clamp
51 terminal block
52 shield clamp

The invention claimed is:

1. An electric connector that is, for allowing information transmission/reception apparatuses incorporated in a plurality of vehicles constituting a train to transmit and receive train information in an interconnecting manner via an in-vehicle cable, interposed between the in-vehicle cable and the information transmission/reception apparatus, wherein the in-vehicle cable internally includes a plurality of signal lines that transmit the train information and an electrically-conductive shielded layer surrounding the signal lines, one end of a ground line is connected to the electrically-conductive shielded layer, the signal lines are connected to connector pins that are installed in an electrically-conductive connector case, which is a casing of an electric connector with a width in a lateral direction narrower than a width in a longitudinal direction, and that are electrically insulated from the electrically-conductive connector case, a casing ground is provided to a casing of the information transmission/reception apparatus, and a plurality of contact pins electrically insulated from the casing of the information transmission/reception apparatus and electrically connected to the connector pins are provided to the casing of the information transmission/reception apparatus, and the other end of the ground line is connected to the electrically-conductive connector case in a detachable manner, and the electrically-conductive connector case is electrically connected to the casing of the information transmission/reception apparatus in a state where the contact pins and the connector pins are respectively connected to each other, a terminal block is provided on a side surface of the electrically-conductive connector case to be interposed between an electrically-conductive terminal provided to the other end of the ground line and the electrically-conductive connector case and fixes the terminal by using a fixing member, and the electrically-conductive terminal has the fixing member inserted through at a central portion thereof and is formed in a shape of a flat plate.

2. The electric connector according to claim 1, wherein an electrically-conductive connector housing that surrounds the contact pins and is formed to be engageable with an outer circumferential surface of the electrically-conductive connector case is provided on the casing of the information transmission/reception apparatus, and the electrically-conductive connector case is electrically connected to the electrically-conductive connector housing by being brought into contact with an inner circumferential surface or an outer circumferential surface of the electrically-conductive connector housing right before the contact pins and the connector pins are electrically connected to each other.

3. The electric connector according to claim 1, wherein an opening for introducing the signal lines and the ground line is formed on the electrically-conductive connector case, and the terminal block is provided in the electrically-conductive connector case at a position near the opening.

4. A train-information transmission/reception system comprising:

information transmission/reception apparatuses that are incorporated in a plurality of vehicles constituting a train and transmit and receive train information in an interconnecting manner;

an in-vehicle cable that is arranged in the plurality of vehicles and includes a plurality of signal lines that transmit the train information and an electrically-conductive shielded layer surrounding the signal lines; and an electric connector that is interposed between the in-vehicle cable and the information transmission/reception apparatus, wherein the in-vehicle cable includes a plurality of signal lines that transmit the train information and the electrically-conductive shielded layer surrounding the signal lines, one end of a ground line is connected to the electrically-conductive shielded layer, the signal lines are connected to connector pins that are installed in an electrically-conductive connector case, which is a casing of the electric connector with a width in a lateral direction narrower than a width in a longitudinal direction, and that are electrically insulated from the electrically conductive connector case, a casing ground is provided to a casing of the information transmission/reception apparatus, and a plurality of contact pins electrically insulated from the casing of the information transmission/reception apparatus and electrically connected to the connector pins are provided in the casing of the information transmission/reception apparatus, and the other end of the ground line is connected to the electrically-conductive connector case in a detachable manner, and the electrically-conductive connector case is electrically connected to the casing of the information transmission/reception apparatus in a state where the contact pins and the connector pins are respectively connected to each other, a terminal block is provided on a side surface of the electrically-conductive connector case to be interposed between an electrically-conductive terminal provided to the other end of the ground line and the electrically-conductive connector case and fixes the terminal by using a fixing member, and the electrically-conductive terminal has the fixing member inserted through at a central portion thereof and is formed in a shape of a flat plate.

5. The train-information transmission/reception system according to claim 4, wherein an electrically-conductive connector housing that surrounds the contact pins and is formed to be engageable with an outer circumferential surface of the electrically-conductive connector case is provided on the casing of the information transmission/reception apparatus, and the electrically-conductive connector case is electrically connected to the electrically-conductive connector housing by being brought into contact with an inner circumferential surface or an outer circumferential surface of the electrically-conductive connector housing right before the contact pins and the connector pins are electrically connected to each other.

6. The train-information transmission/reception system according to claim 4, wherein an opening for introducing the signal lines and the ground line is formed on the electrically-conductive connector case, and the terminal block is provided at a position near the opening.

7. A method for connecting an electric connector that is, for allowing information transmission/reception apparatuses incorporated in a plurality of vehicles constituting a train to transmit and receive train information in an interconnecting manner via an in-vehicle cable, interposed between the in-vehicle cable and the information transmission/reception apparatus, the method comprising:

a step of connecting one end of a predetermined ground line to an electrically-conductive shielded layer internally included in the in-vehicle cable;

a step of connecting a plurality of signal lines for transmitting the train information included in the in-vehicle cable to connector pins that are installed in an electrically-conductive connector case, which is a casing of the electric connector with a width in a lateral direction narrower than a width in a longitudinal direction, and that are electrically insulated from the electrically-conductive connector case;

a step of connecting a flat-plate electrically-conductive terminal connected to the other end of the ground line to a terminal block formed on a side surface of the electrically-conductive connector case by using a fixing member in a detachable manner;

a step of providing a casing ground of the information transmission/reception apparatus; and a step of electrically connecting the casing of the information transmission/reception apparatus and the electrically-conductive connector case in a state where a plurality of contact pins, which are electrically insulated from the casing of the information transmission/reception apparatus and electrically connected to the connector pins, and the connector pins are respectively engaged with each other.

8. The method for connecting an electric connector according to claim 7, wherein an electrically-conductive connector housing that surrounds the contact pins and is formed to be engageable with an outer circumferential surface of the connector case is provided in the casing of the information transmission/reception apparatus, and in the step of electrically connecting the casing of the information transmission/reception apparatus and the electrically-conductive connector case, a step of electrically connecting the electrically-conductive connector case and an inner circumferential surface or an outer circumferential surface of the electrically-conductive connector housing is included right before the contact pins and the connector pins are electrically connected to each other.

9. The method for connecting an electric connector according to claim 7, wherein an opening for introducing the signal lines and the ground line is formed on the electrically-conductive connector case, and in the step of fixing the terminal to the terminal block by using the fixing member, a step of fixing the terminal to the terminal block that is provided in the electrically-conductive connector case at a position near the opening is included.

* * * * *